United States Patent [19]

Oskam

[11] Patent Number: 4,529,025

[45] Date of Patent: Jul. 16, 1985

[54] VANE POCKET COVER FOR BLIND

[75] Inventor: Herman Oskam, Bergambacht, Netherlands

[73] Assignee: Hunter Douglas International N.V., Rooi Catootje, Netherlands Antilles

[21] Appl. No.: 574,375

[22] Filed: Jan. 27, 1984

[30] Foreign Application Priority Data

Mar. 23, 1983 [NL] Netherlands ..... 8301036

[51] Int. Cl.[3] ..... E06B 9/38

[52] U.S. Cl. ..... 160/178 R; 160/166 A

[58] Field of Search ..... 160/166–178; 248/222.4

[56] References Cited

U.S. PATENT DOCUMENTS

| | | | |
|---|---|---|---|
| 3,106,240 | 10/1963 | Weber | 160/166 A |
| 3,500,896 | 3/1970 | Endou | 160/168 R |
| 4,267,875 | 5/1981 | Koks | 160/168 R |
| 4,356,855 | 11/1982 | Holzer | 160/178 R |
| 4,389,133 | 6/1983 | Oberst | 248/222.4 |

FOREIGN PATENT DOCUMENTS

| | | | |
|---|---|---|---|
| 37568 | 5/1968 | Australia . | |
| 2293570 | 7/1976 | France | 160/166 A |
| 6901504 | 8/1969 | Netherlands . | |
| 7609987 | 9/1976 | Netherlands . | |
| 7804423 | 10/1979 | Netherlands | 160/166 A |

*Primary Examiner*—Peter M. Caun

*Attorney, Agent, or Firm*—Pennie & Edmonds

[57] ABSTRACT

A vane pocket cover for taking up the bottom end of a vane of a vertical blind, preferably including an additional weight, whereby the cover has protruding parts near the front and rear wall centers offset with respect to each other, for simple connection of vane interconnecting means. The cover is easily engageable by being pushed over a folded vane bottom end that could enclose a weight whereby the vane material stretches through the cover and out through a slit. The cover versions are especially designed for do-it-yourself purposes and concentrate on ease of assembling and vane length adjustment.

7 Claims, 6 Drawing Figures

VANE POCKET COVER FOR BLIND

The invention relates to a vane pocket cover for blinds with vertical vanes, which pocket cover comprises at least one front- and one rear wall and is able to take up a vane portion between front- and rear wall at or near a vane end.

These known vane pocket covers are used for finishing of the bottom side of the vanes and may have various additional secondary functions as well. Thus they may serve as weight increase to make the vane to hang tight, or they may have extra provisions for mutually connecting successive vanes, etc. As large numbers of vanes are involved for blinds, the assembling of such blinds is a labour intensive activity. Moreover the vane bottom ends of the so-called vertical blinds form a rather striking part, so that the appearance thereof is determinative for the attractiveness of the product as such. As in addition the do-it-yourself aspect for such products is becoming more and more important, by which the elimination of possible failures and the possibility of self finishing is also playing an important part, the systems used in practice appear to be no longer satisfactory.

It is an object of the invention to provide vane pocket covers, which are devoid of the existing disadvantages.

If a vane pocket cover is used for a start, provided with at least a front- and a rear wall and capable of taking up a vane portion between the front- and the rearwall at or near a vane end, then the intended object according to the invention is achieved in that the front- and rear-wall are provided with a protruding part in or near the centre, provided with a provision for attaching an end of a connecting means, which protruding parts are positioned at different sides with respect to a perpendicular bisector on the longitudinal centerline of the pocket cover.

With this construction the advantage is achieved, that the mutual connections between successive vanes can be predetermined by measured parts of connecting means, only one connecting means has to be used between two successive vanes, which can be positioned also in a very simple manner and notwithstanding that the vanes can be located very close to each other when forming a packet, because the protruding parts of adjacent pocket covers facing each other will be positioned next to each other.

According to a further feature of the invention the side walls of the protruding parts may be shaped to converge from the wall of the pocket cover. Thereby a search ledge is created promoting the adjacent joining of the protruding parts. A further embodiment according to the invention is characterized in that each protruding part is provided with a frontal slot of a take-up space, limited at the bottom for taking up a thickened end of a connecting means, e.g. a ball of a ball-chain, a knot, etc.

When using certain connecting means, such as ball-chain sections, this embodiment makes mounting very easy.

In the embodiment described just now another embodiment of the invention can be made use of, which is characterized in that the lower limitations of the take-up space consists of a separate abutment, positioned at a distance from the bottom of the protruding part, which is larger than the thickness of a mounted connecting means at that place. When using a connecting means having a certain stiffness, it is prevented by this measure that on turning of the vanes a counter pressure is exerted by the connecting means opposing the turning movement, as here the connecting means can adjust itself into a position parallel to the plane of the vanes. The advantage of the application of protruding parts is simultaneously clearly shown hereby.

The application is also directed to vane pocket covers which are meant especially though not exclusively for application in the do-it-yourself sphere, wherein the finishing of the bottom end is carried out by the purchaser himself. Such a vane pocket cover is known a.o. from the Dutch patent application no. 7804423, wherein the pocket cover described is a case with front, rear, and side walls allowing it to catch beyond the upper end of a turned up bottom end of a vane while the pocket cover is simultaneously provided with attachment means for the attachment of connecting means, connecting consecutive vane bottom ends. In this known construction the person who finishes the vane should turn the bottom end of a vane over a specifically shaped plate, provided with a slit through which the vane end is put, whereafter the assembly is turned up and a case, open towards two sides is slipped over the upper end in order to fix this upper end. The metal plate forming the bottom weight is provided with a special shape in order to cooperate with certain free spaces in the case for fixing the case. This case is provided at its side portions with hooks, which cooperate with eyes on a passing chain, connecting the mutual side portions of the vanes. This construction, meant for the do-it-yourself sphere has various disadvantages. The case in itself has no fixing possibilities, as it is freely shifted and therefore should be provided with special attachment means, cooperating with plate means. This in turn has as a consequence that the plate requires special punchwork and thus moulds, making this plate extremely expensive. The case itself has a very minor stiffness of its own, causing the front- and rear walls to yield under pressure of the intermediate material. The attachment of the ball-chains sideways hampers a proper turning over of the vanes and necessitates the use of chains and connecting means at both sides of the vane. This makes the construction needlessly expensive and cumbersome, whereas the result is less attractive, also visually.

The invention provides a distinct solution for these disadvantages and is characterized to that end in that the pocket cover is carried out as a cap with a top wall, in which top wall a narrow slit is present for the passage of a vane strip, which slit is positioned excentrical with respect to the longitudinal axis of the bottom of the pocket cover.

It will be obvious that this cap has a higher stiffness as pocket cover, allows the use of a completely straight cut metal plate forming the bottom weight, which can thus be cut from strip metal without extra treatment. Moreover, the vane material leaving at the upper end is guided through a specially measured slit and it does just require little force to have the vane pocket cover engage the vane material end and the bottom weight. With this connection it is also immaterial which part of the plate is turned upwards.

According to a preferred embodiment of the invention the pocket cover may be characterized in addition in that the side parts of the pocket cover are longer than the central part, and the front- and rear walls merge with the side walls by means of a slanted or curved line.

By this embodiment the yielding of the turned up vane material with respect to the plate located therein is prevented, while during inserting some type of guidance is also available, which simplifies and accelerates mounting.

The higher stiffness and strength of this construction is of particular importance when the protruding parts are applied for coupling of the connecting means. As these protruding parts are located at the centre of the pocket cover the front- and rear portions of the case would start to bulge in the embodiment according to the Dutch patent application described above, under the tractive power, though small, exerted by the connecting means. This aspect of the invention contributes to obtain an extremely advantageous combination.

The invention will now be elucidated by an example of an embodiment as illustrated in a drawing.

Figure 1:
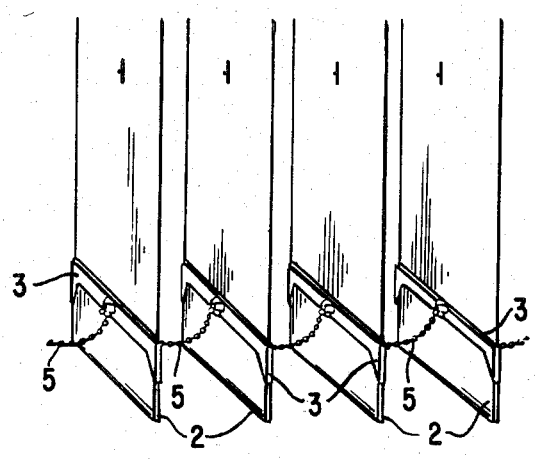
FIG. 1 shows in perspective the bottom ends of a series of vanes provided with pocket covers according to the invention.
Figure 2:
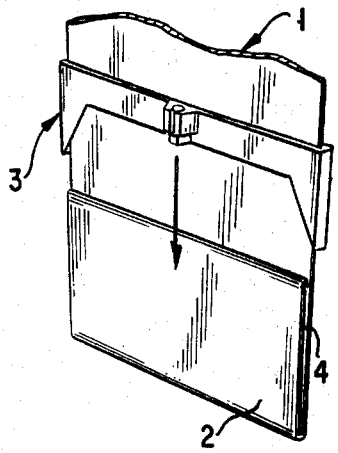
FIG. 2 shows a perspective view of a vane bottom end and a pocket cover immediately prior to positioning the pocket cover.
Figure 4:
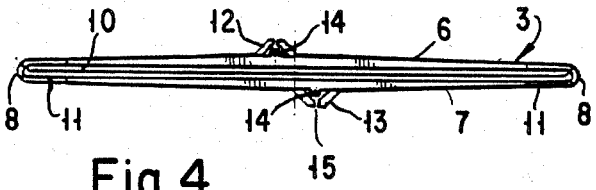
FIG. 4 shows a bottom view of the pocket cover according to FIGS. 1–3.

In FIG. 1 the bottom parts of a number of vanes 1 are shown, the turned up ends 2 being kept in turned up position by pocket covers 3, whether or not with inclusion of a bottom weight or plate 4 (FIG. 2). The pocket covers 3 are mutually connected by ball chains 5, with which the vanes are kept at certain mutually identical distances when the blind is drawn out.

The example according to the invention as presented in the drawing provides a combination of all features as these are laid down in the claims. Of course a range of embodiments is possible within the scope of the invention.

The pocket cover according to this example is carried out as a hood, i.e. it has a front wall 6 and a rear wall 7, side walls 8 and a top wall 9. In this top a narrow longitudinal slit 10 has been arranged, which in its longitudinal and transverse dimension has been adapted to the width and depth of the vane material. Thus not only a visually attractive and well finished view are obtained, but also the material is kept properly flat on applying the hood over the turned up vane end. The slit 10 has been made in the middle with respect to the longitudinal axis of the hood and the distance between front- and rear walls is such that the turned up vane bottom end, if desired together with a bottom weight or plate, may be assimilated therein. Thus the application of the hoof is facilitated and a possible slanting of the bottom end is prevented. The front- and rear walls diverge slanting (11) towards the side walls, thus providing an extension of the side walls. In this way a type of search ledge is obtained, which facilitates mounting, while also a higher stiffness of the edges is obtained and in mounted form the turned up material is better kept together.

As clearly appears from the figures during mounting first the hood is slid over the vane end with the top at the upper side. Then the vane end is turned over one or more times, whether or not with the addition of a plate shaped weight whereafter the hood is slid downwards and extends beyond the turned up end (FIG. 2). Then the attachment means is hooked up, e.g. such as here a ball chain.

Figure 5:
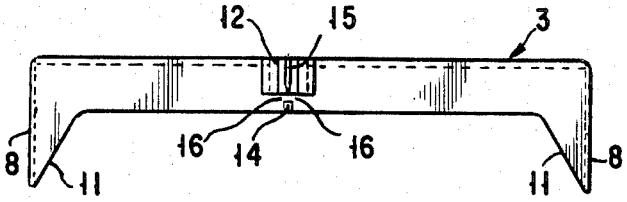
FIG. 5 shows a front view of a pocket cover according to FIGS. 1–3.
Figure 6:
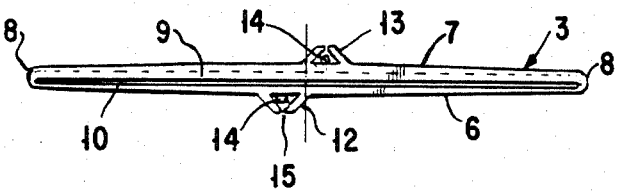
FIG. 6 shows a top view of a pocket cover according to FIGS. 1–3.
Figure 3:
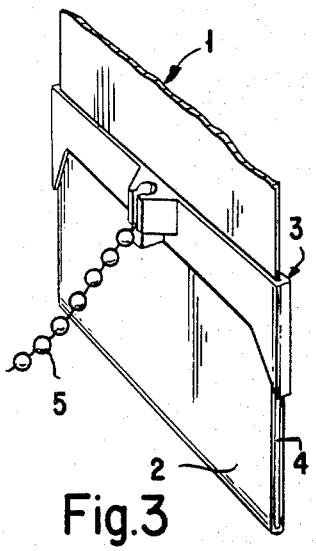
FIG. 3 shows in perspective a vane bottom end with applied pocket cover and ball-chain.

For the mutual connection of the vane bottom ends the hood is provided with recesses forming protrusions 12 and 13 and a ledge 14. The recesses forming protrusions are shifted with respect to each other and the parts are each made converging. With this is achieved that during the formation of the tight packet during the operation of the blind towards a position wherein the window or the opening are left free completely, the vanes can be located as close as possible together in order to make the width of the packet as small as possible. The splaying of these protrusions has the function of search wall, whereby the protruding parts will slide along each other and can not remain resting against each other. In this embodiment every protruding part has been made with two side wall parts, comprising a take-up area for a ball of a ball chain. Between both side walls at the front side a slot 15 has been left open, with a dimension suitable for allowing the passage of the pivotlike interconnections between the balls of the chain. Under the take-up area and at some distance from the bottom of the protruding parts ledges 14 have been provided, serving as lower abutment for the balls present in the take-up area. It can be seen from FIG. 5 that two apertures 16 are formed by this intermediate distance, allowing the pivotlike connection of the ball in the take-up area to turn sideways. Hereby a type of hinge-action is created, which has as its purpose to obstruct or to restrict the turn-over movement of the vanes during the turning over as little as possible. The chain can thus join against the vane flat sideways without causing any strain.

The self-searching effect, the higher stiffness and the better closing off of the upper end of the hood on the one hand and the inexpensive and simple mounting of the vane connecting means on the other hand make this hood extremely suitable for a do-it-yourself product, but also for industrial production the speed and simplicity of the mounting, achievable with the pocket covers according to the invention are of particular importance. Within the scope of the invention various modifications are possible, whereby the version shown in the drawing is presently considered the best mode.

I claim:

1. Vane pocket cover for blinds with vertical vanes, said pocket cover comprising at least one front- and one rear wall and capable of taking up a vane part between front- and rear walls at or near a vane end, characterized in that the front- and the rearwall are provided with a protruding part in or near the centre, with a provision for attaching an end of a connecting means, which protruding parts are located at different sides with respect to a perpendicular bisector on the longitudinal center line of the pocket cover.

2. Vane pocket cover according to claim 1, characterized in that the side walls of the protruding parts converge from the wall of the pocket cover.

3. Vane pocket cover according to claim 1 characterized in that each protruding part is provided with a take-up area, limited at its bottom side, having a front slot for taking up a thickened end of a connecting means, e.g. a ball of a ball-chain, a knot, etc.

4. Vane pocket cover according to claim 3, characterized in that the bottom limitation of the take-up area consists of an independent abutment located at a distance from the bottom side of the protruding part, which is larger than the thickness of a mounted connecting means at that spot but smaller than the smallest dimension of the thickened end of the connecting means to be taken up in the take-up area.

5. Vane pocket cover for blinds with vertical vanes, said pocket cover being provided with front-, rear- and side walls, with which it can reach beyond the upper end of a turned up bottom end of a vane, said pocket cover being also provided with attachement means for attachment of connecting means, connecting successive vane bottom ends, characterized in that the pocket cover has been designed as a hood with a top, a small slit being present in said top for allowing the passage of a vane slat, said slit having been made excentrical with respect to the longitudinal axis of the bottom of the pocket cover.

6. Vane pocket cover for blinds with vertical vanes according to claim 5, characterized in that the side parts of the pocket cover are longer than the central part and the front- and rear walls merge with the side walls by means of a slanted or curved line.

7. Vane pocket cover for blinds with vertical vanes, said pocket cover being provided with at least one front and one rear wall and taking up a vane part between front and rear walls at or near a vane end, characterized in that the front- and rear walls are provided in or near the centre with a protruding part, having a provision for the attachment of an end of a connecting means, said protruding parts being located at different sides with respect to a perpendicular bisector on the longitudinal center line of the pocket cover, the pocket cover simultaneously being made as a hood with a top, a small slit being present in said top for allowing the passage of a vane slat, said slit having been made excentrical with respect to the longitudinal axis of the bottom of the pocket cover.

* * * * *